US006418833B1

(12) United States Patent
Hajjar

(10) Patent No.: US 6,418,833 B1
(45) Date of Patent: Jul. 16, 2002

(54) RECOIL SPRING TUBE ASSEMBLY

(76) Inventor: Jeffrey A. Hajjar, 1360 Armand St., Kuna, ID (US) 83634

( * ) Notice: Subject to any disclaimer, the term of this patent is extended or adjusted under 35 U.S.C. 154(b) by 0 days.

(21) Appl. No.: 09/578,360

(22) Filed: May 24, 2000

Related U.S. Application Data

(63) Continuation-in-part of application No. 09/411,479, filed on Oct. 1, 1999.

(51) Int. Cl.[7] ..... F41A 3/84
(52) U.S. Cl. ..... 89/199; 89/198; 89/44.01
(58) Field of Search ..... 89/198, 199, 44.01

(56) References Cited

U.S. PATENT DOCUMENTS

| | | | | | |
|---|---|---|---|---|---|
| 447,836 | A | * | 3/1891 | Maxim | 89/198 |
| 632,134 | A | * | 8/1899 | Meigs et al. | 89/44.01 |
| 2,211,405 | A | | 8/1940 | Browning | 42/3 |
| 2,379,461 | A | * | 7/1945 | Simpson | 89/198 |
| 2,909,101 | A | | 10/1959 | Hillberg | 89/191 |
| 3,200,710 | A | | 8/1965 | Kelly et al. | 89/191 |
| 3,366,011 | A | * | 1/1968 | Sturtevant | 89/198 |
| 3,408,062 | A | | 10/1968 | Baker | 267/1 |
| 3,580,132 | A | | 5/1971 | Vartanian | 89/130 |
| 3,680,433 | A | * | 8/1972 | Tollinger | 89/198 |
| 3,683,534 | A | | 8/1972 | Davis | 42/1 R |
| 3,848,511 | A | | 11/1974 | Zanoni | 89/191 A |
| 3,977,296 | A | * | 8/1976 | Silsby et al. | 89/198 |
| 4,088,057 | A | | 5/1978 | Nasypany | 89/1.701 |
| 4,102,242 | A | | 7/1978 | Liedke | 89/191 R |
| 4,156,979 | A | | 6/1979 | Katsenes | 41/1 V |
| 4,164,825 | A | | 8/1979 | Hutchinson | 42/1 V |
| 4,279,091 | A | | 7/1981 | Edwards | 42/1 V |
| 4,485,723 | A | * | 12/1984 | Sarony | 89/198 |
| 4,492,050 | A | | 1/1985 | Kagehiro | 42/1 V |
| 4,503,632 | A | * | 3/1985 | Cuevas | 42/1.06 |
| 4,505,183 | A | | 3/1985 | Grehl | 89/191.01 |
| 4,514,921 | A | | 5/1985 | Burkleca | 42/1 V |
| 4,524,374 | A | | 6/1985 | Gernstein | 42/1.06 |
| 5,060,555 | A | * | 10/1991 | Sater et al. | 89/198 |
| 5,127,310 | A | * | 7/1992 | Lishness et al. | 89/199 |
| 5,827,992 | A | * | 10/1998 | Harris et al. | 89/198 |
| 5,872,323 | A | | 2/1999 | Norton et al. | 89/191.02 |

FOREIGN PATENT DOCUMENTS

| | | | | |
|---|---|---|---|---|
| DE | 1234586 | * | 2/1967 | 89/44.01 |

* cited by examiner

*Primary Examiner*—Stephen M. Johnson
(74) *Attorney, Agent, or Firm*—Joseph W. Holland

(57) ABSTRACT

An improved recoil spring tube assembly for an auto-loading firearm includes a recoil spring slideable within a recoil spring tube and including a recoil spring follower all manufactured of a corrosion resistant material. The bore of the recoil spring tube and the contact surface area of the guide collar of the recoil spring follower are honed or polished to provide a surface having an average surface roughness between 1.0 $\mu$in. and 30.0 $\mu$in. The recoil spring tube assembly is configured such that the recoil spring has a spring rate greater than 0.80. In one embodiment of the invention, the recoil spring tube assembly includes a recoil spring follower sized and configured so as to have a mass that results in an assembly wherein the ratio of the recoil spring follower mass to the recoil spring rate, or displacement constant is in the range of 0.10–0.30.

19 Claims, 3 Drawing Sheets

RECOIL SPRING TUBE ASSEMBLY

RELATED APPLICATION

This application claims the priority of and is a Continuation-in-Part of an application entitled Recoil Spring Tube Assembly, serial number 09/411,479 filed Oct. 1, 1999.

BACKGROUND OF THE INVENTION

1. Technical Field

The present invention relates generally to auto-loading firearms, and more particularly to an improved auto-loading system including an improved recoil spring assembly.

2. Background

There exists two distinct types of auto-loading shotguns: recoil operated and gas operated. In each case, forces resulting from the discharge of the firearm are controlled to some extent and employed in cycling the breech bolt assembly in order to discharge a spent round and reload the gun following discharge of the shell. In each case, the auto-loading cycle occurs in two segments. The first segment of the auto-loading cycle is the discharge of the spent round and cycling of a subsequent round from the magazine to a positioning mechanism for loading during the second segment. The first segment is characterized by the movement of the breech bolt assembly in a rearward direction. Energy from the movement of the breech bolt assembly to the rearward position in the receiver is stored in both the case of the recoil operated auto-loading firearm and the gas operated auto-loading firearm in a magazine spring which surrounds the magazine tube and in a recoil spring located in the butt of the firearm. The recoil spring is commonly housed in a recoil spring tube and is acted upon by a link which attaches to an action bar which in turn attaches to the slide portion of the reload mechanism.

The second segment involves the movement of the subsequent round by the positioning mechanism into the breech for movement to the battery position. The second segment is characterized by the movement of the breech bolt assembly in a forward direction. In the second half of the auto-loading cycle, energy stored in the recoil spring is utilized to move the breech bolt assembly forward, lifting the elevator in order to position the next round for firing, thereby completing the auto-loading cycle.

The first type of auto-loading firearm achieves the auto-loading cycle by employing a discharge and loading mechanism which is activated by the recoil of the gun. In this case, when the shotgun is fired, a resulting force is exerted against the breech bolt assembly driving the bolt towards the rear of the firearm within the receiver.

The second type of auto-loading system, the gas operated auto-loading firearm, achieves the auto-loading cycle by employing a loading mechanism which is activated by gas generated by the discharge of the firearm. When a round is fired, gas generated by the discharge of the firearm is diverted to a cylinder which is commonly arranged about the magazine tube, through a small port in the barrel of the firearm, causing a piston to move in a rearward direction carrying the breech bolt assembly to a rearward position.

The prior art relating to auto-loading firearms is concentrated for the most part on the mechanism which enables the function of the first half of the cycle, that is moving the breech bolt to the rearward position in the receiver and discharge of the spent round.

In a gas operated auto-loading firearm, the structure relating to the first half of the cycle includes the cylinder with its associated piston which typically surrounds the magazine tube. The cylinder typically attaches to the bolt by means of an action bar. Gas from the discharge of the firearm is directed to the cylinder and against the piston through a gas port located in the barrel of the firearm. This structure, together with improvements thereto, has been disclosed broadly in the prior art. See generally Browning, U.S. Pat. No. 2,211,405; Hillberg, U.S. Pat. No. 2,909,101; Kelly et al., U.S. Pat. No. 3,200,710; Vartanian, U.S. Pat. No. 3,580,132; Zanoni, U.S. Pat. No. 3,848,511; Liedke, U.S. Pat. No. 4,102,242; Grehl, U.S. Pat. No. 4,505,183 and Norton et al., U.S. Pat. No. 5,872,323.

The fact that such a great deal of attention has been paid to that structure which affects the movement of the breech bolt assembly in the rearward direction within the receiver and so little attention has been afforded that mechanism which returns the breech to the forward, or battery, position within the receiver, is somewhat a matter of curiosity. This fact is of particular interest considering that it is within the second half of the cycle that jamming of the firearm most often occurs. Experience has shown that jamming occurs for a number of reasons, including the presence of dirt and debris including rust and corrosion within the various moving component parts of the firearm. Specifically, it has been found that corrosion and wear within the recoil tube affects both the cycling speed and performance of the firearm. Additionally, jamming may occur when an attempt is made to cycle the action when loads are fired which generate chamber pressures which are greater or lesser than those for which the gun is set up. It is often the case, in firearms that are manufactured according to the prior art, that a variety of interchangeable recoil springs having a variety of configurations may be employed in order to effect a smooth transfer of the breech bolt assembly to the battery position depending on the size and configuration of the particular load being fired. Jamming may occur when recoil spring characteristics and the load are mismatched.

Additionally, it has been observed that recoil spring tube assemblies according to the prior art have employed relatively light weight recoil springs, that is springs having relatively low spring rates, less than 0.50, where spring rate is defined as the load in pounds required to produce one inch of linear deflection in the spring. Recoil springs having low spring rates have a tendency, when subjected to the repeated cycling of an auto-loading firearm, to buckle or deform reducing substantially their efficiency. Additionally, light springs tend to absorb recoil energy inefficiently oftentimes allowing the stem of the recoil spring follower to bottom out against the rear end of the recoil spring tube causing damage to the recoil spring tube assembly.

Likewise, it has been observed that recoil spring tube assemblies according to the prior art have employed followers that have relatively low mass. It has been observed that the combination of springs having relatively low spring rates with followers that have relatively low mass results in a mechanism which lacks the required inertia to cycle in a sure and consistently repeatable manner regardless of the load being chambered or the degree of foreign matter within the various sub-assemblies of the firearm.

Followers manufactured according to the prior art are configured having circumferential surfaces that bear against the internal bore of their respective recoil spring tubes that are flat, relatively wide and unpolished. Additionally, it has been observed that followers, manufactured according to the prior art and formed of materials that are not corrosion resistant begin to perform the function of sliding within the recoil spring tube less satisfactorily with age or when exposed to moisture or even ambient humidity. Additionally, it has been observed that materials may be used for forming the follower which are unsuitable or mismatched with the materials employed in forming the recoil spring tube. Again this may result in less than optimum or deteriorating performance. It has been observed that in auto-loading firearms manufactured according to the prior art, followers have a tendency to gall or abrade when subjected to the repetitious sliding creating even greater friction and resistance between the follower and the internal bore of the recoil spring tube further decreasing the efficiency of the recoil spring tube assembly and therefore the auto-loading capability of the firearm.

SUMMARY OF THE INVENTION

According to the present invention, a recoil spring tube assembly for an auto-loading firearm includes a recoil spring tube having first and second ends with the first end being closeable to retain a recoil spring which is inserted within the recoil spring tube. The recoil spring tube assembly also includes a recoil spring follower which is inserted above the recoil spring with the stem of the recoil spring follower engaging the recoil spring. The forward end of the recoil spring follower is configured to engage the link arm.

According to the present invention, the recoil spring follower includes at least one guide collar having a reduced circumferential contact surface area. By reduced circumferential contact surface area it is meant that the running surface of the collar is reduced to an angle or radius such that a minimum portion of the collar is in contact with the bore of the recoil spring tube during sliding engagement. In addition, the bore of the recoil spring tube is honed or polished to provide a surface having an average surface roughness between 1.0 $\mu$in. and 30.0 $\mu$in. Similarly, the contact surface area of the guide collar of the recoil spring follower is polished so that it too has an average surface roughness between 1.0 $\mu$in. and 30.0 $\mu$in. In both the case of the bore of the recoil spring tube and the contact surface area of the guide collar of the recoil spring follower, an average surface roughness of approximately 15 $\mu$in. has been shown to provide an economic as well as a functional compromise.

In the preferred embodiment of the invention, the recoil spring tube, the recoil spring and the recoil spring follower are all manufactured employing stainless steel, preferably a type 302. In one embodiment of the present invention, the recoil spring tube assembly includes a recoil spring having a spring rate greater than 0.80. It has been observed that a recoil spring having an increased or relatively greater spring rate deflects less under load and therefor results in a recoil spring tube assembly that cycles faster.

It has been observed that an optimum range exists for a ratio of follower mass to spring rate for a particular firearm firing a specific load. Displacement constant is defined herein as the ratio of follower mass to spring rate. It has been observed that the optimum range for the displacement constant for a recoil spring tube assembly for a 12 gauge shotgun firing a 3½" shell is in the range of 0.10–0.30, according to the following equation: $R=m/SR$, where m=the mass of the follower in pounds and SR=spring rate=$P/\delta$ where P=1 pound and $\delta$= deflection in inches. It has been observed that recoil spring tube assembly having a very low displacement constant, i.e. less than 0.03, exhibits a propensity to "bottom out", that is upon discharge of the firearm, the spring may actually compress completely. The result may be slow cycle times and, over a period of time, damage to recoil spring tube assembly components, particularly spring deformation and follower wear. Conversely, firearms including a recoil spring tube assembly having a relatively high displacement constant i.e. greater than 0.30 exhibit a propensity to "jam" upon discharge of the fire arm, particularly when the user switches to lighter loads.

For instance, a twelve gauge shotgun having a recoil spring assembly according to the prior art may include a recoil spring having a spring rate of 0.40 in., and a follower having a mass of 3.1 ounces or 0.1938 pounds, the displacement constant according to the above formula would be 0.4844. According to the present invention, a recoil spring assembly for the same shotgun may include a recoil spring and follower combination including a recoil spring having a spring rate of 0.9086 in., and a follower having a mass of 3.1 ounces or 0.1938 pounds, the displacement constant according to the above formula would be 0.2132. Similarly, a twelve gauge shotgun having a recoil spring assembly according to the prior art may include a recoil spring having a spring rate of 0.75 in., and a follower having a mass of 0.3 ounces or 0.0188 pounds, the displacement constant according to the above formula would be 0.0250. Once again and according to the present invention, a recoil spring assembly for the same shotgun may include a recoil spring and follower combination including a recoil spring having a spring rate of 0.9293 in., and a follower having a mass of 1.8 ounces or 0.1125 pounds, resulting in a displacement constant according to the above formula of 0.1211.

The recoil spring tube assembly according to the present invention also includes an attaching member for attaching the recoil spring tube assembly to the firearm. Typically, attachment to the firearm is achieved by means of a threaded connection which allows attachment of the recoil spring tube assembly to the receiver.

Other advantages will become apparent to those skilled in the art from the following detailed description read in conjunction with the appended claims.

DETAILED DESCRIPTION OF THE INVENTION

Figure 1:
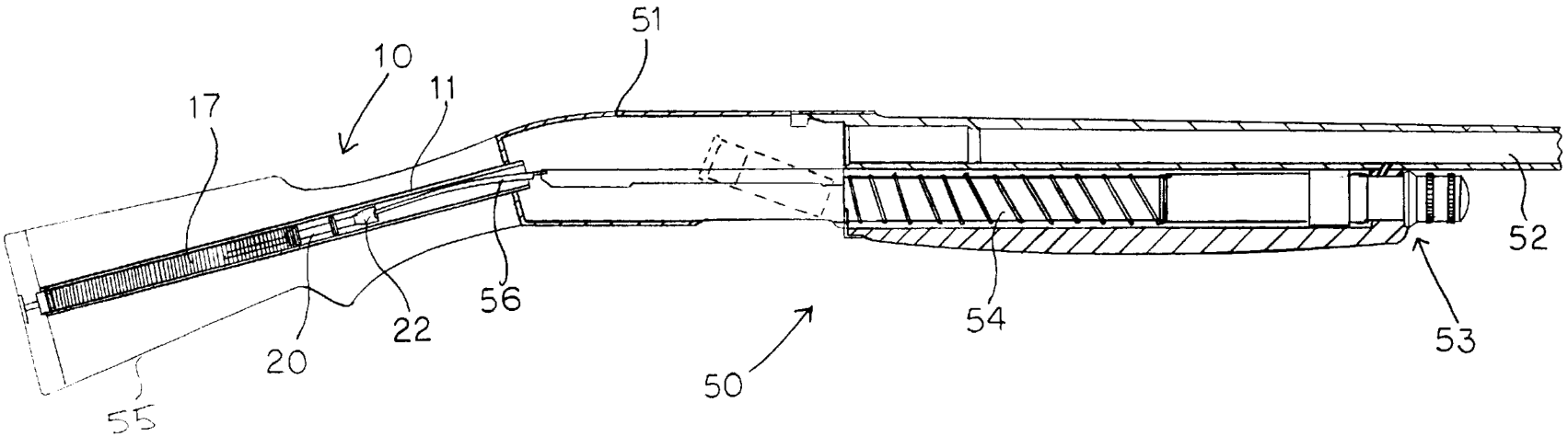
FIG. 1 is a representational partial cutaway view of an auto-loading firearm including an improved recoil spring assembly according to the present invention.

FIG. 1 shows auto-loading firearm 50 including receiver 51 having attached at a front end, barrel 52 and at the rear end butt 55. Located below and attached to barrel 52 is auto-loading mechanism 53 which is configured about magazine 54. Recoil spring tube assembly 10 is shown located within butt 55 of auto-loading firearm 50.

Figure 2:
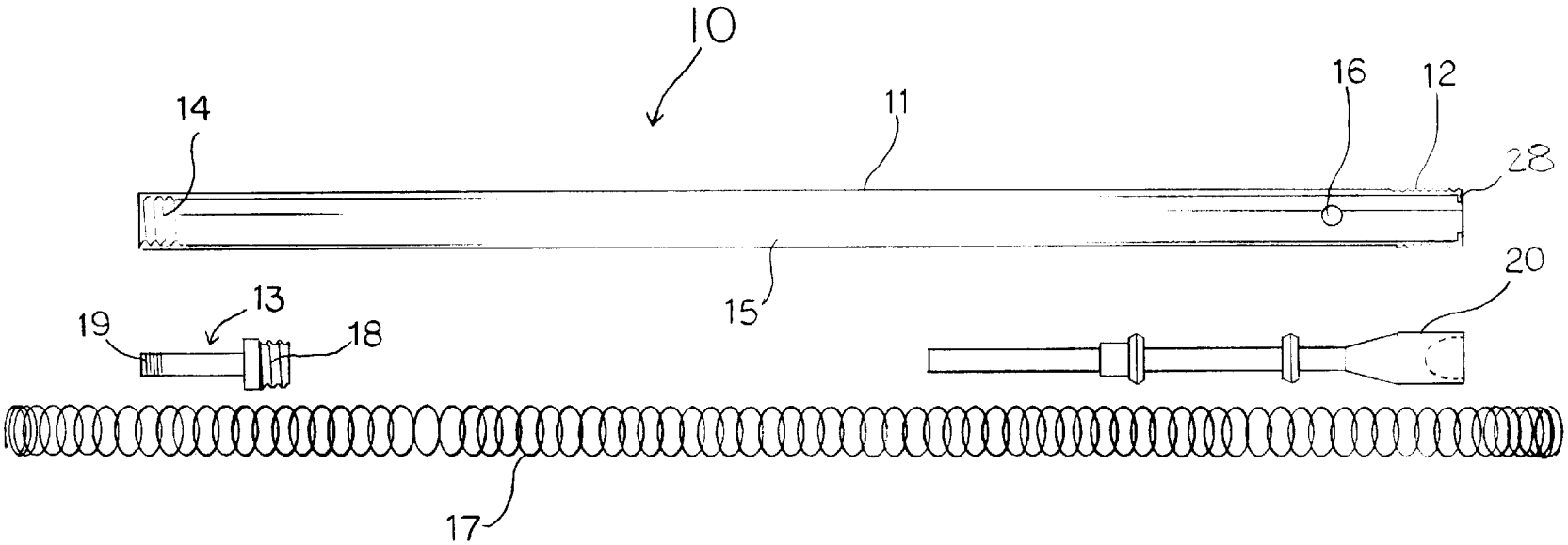
FIG. 2 is an exploded representational view of an improved recoil spring assembly according to the present invention.

FIG. 2 shows recoil spring tube assembly 10 according to the present invention disassembled. As shown, recoil spring tube assembly 10 includes recoil spring tube 11 having a first end which includes external thread 12 for threaded engagement to receiver 51 (shown in FIG. 1). Recoil spring tube 11 also includes internal thread 14 for engagement with keeper 13. Recoil spring tube 11 also includes in the preferred embodiment of the invention, a polished internal bore 15. Keeper 13 is configured having first threaded end 18 for threaded engagement with internal thread 14. Keeper 13 also may include a second threaded end 19 which permits attachment of butt 55 (shown in FIG. 1). In the preferred embodiment of the invention, recoil spring tube 11 is configured having lip 28 which serves to retain recoil spring follower 20 within recoil spring tube 11. Weep hole 16 provides an outlet for moisture and air.

As shown in FIG. 2, recoil spring tube assembly 10 also includes recoil spring 17 and recoil spring follower 20.

Figure 3A:
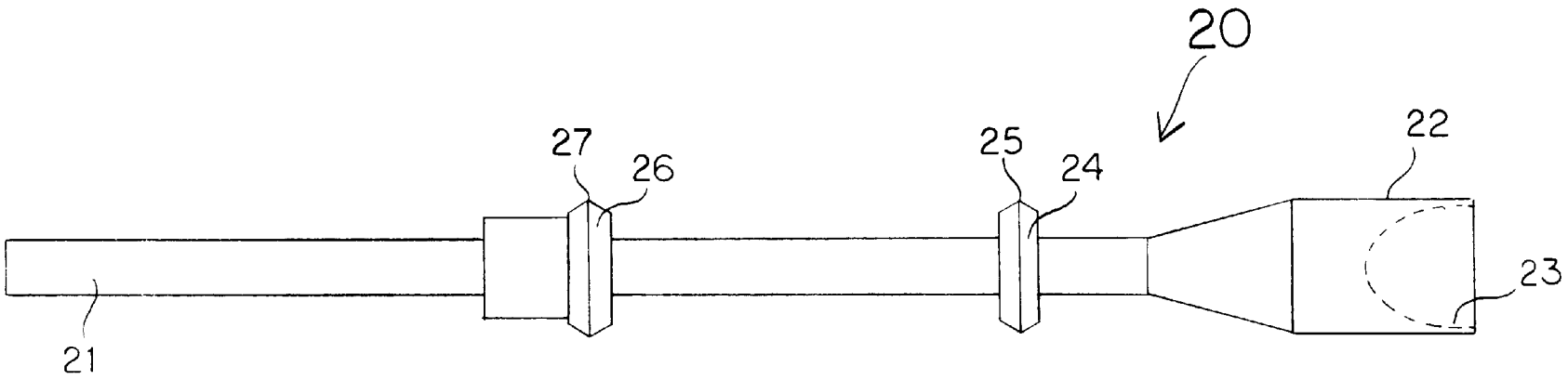
FIG. 3A is a side representational view of one embodiment of a recoil spring follower according to the present invention.
Figure 3B:
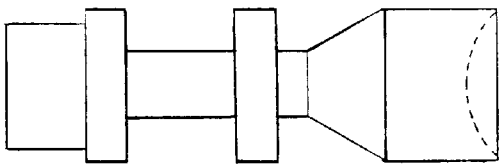
(PRIOR ART) FIG. 3B
FIG. 3B is a side representational view of one embodiment of a recoil spring follower according to the prior art.

Referring to FIG. 3A, recoil spring follower 20 is shown including elongated follower stem 21 having formed thereon first guide collar 24 and second guide collar 26. In the preferred embodiment of the invention first guide collar 24 is configured having first reduced circumferential contact surface area 25. Similarly, second guide collar 26 is configured having second reduced circumferential contact surface area 27. In both the case of first guide collar 24 and second guide collar 26, the respective reduced circumferential contact surface areas are polished to reduce friction between the outer circumferential contact surface area of first guide collar 24 and second guide collar 26 and internal bore 15 of recoil spring tube 11 (shown in FIG. 2). The fit between the outer circumferential contact surface area of first guide collar 24 and second guide collar 26 and the internal bore 15 of recoil spring tube 11, in the preferred embodiment is a free running fit, although the invention may be practiced in devices exhibiting both tighter and looser fits as long as sliding cooperation between internal bore 15 of recoil spring tube 11 and recoil spring follower 20 is permitted. FIG. 3A also shows recoil spring follower 20 having link socket 22 including oversized pocket 23 for receiving link 56 (shown in FIG. 1).

As shown in FIG. 1, recoil spring tube assembly 10 is located within butt 55 of auto-loading firearm 50. Link 56 engages link socket 22 of recoil spring follower 20. Recoil spring 17 is shown inserted within recoil spring tube 11.

While this invention has been described with reference to the described embodiments, this is not meant to be construed in a limiting sense. Various modifications to the described embodiments, as well as additional embodiments of the invention, will be apparent to persons skilled in the art upon reference to this description. It is therefore contemplated that the appended claims will cover any such modifications or embodiments as fall within the true scope of the invention.

I claim:

1. An improved recoil spring tube assembly for an auto-loading firearm, wherein the improvement comprises:

a recoil spring tube having a closed first end and an open second end, the recoil spring tube including an internal bore having a polished surface;

a recoil spring inserted and retained within the recoil spring tube;

a recoil spring follower inserted within the recoil spring tube and engaging the recoil spring, the recoil spring follower including at least one guide collar having a polished circumferential contact surface area having an average surface roughness in the range of 1.0 $\mu$in. to 30.0 $\mu$in., the circumferential contact surface area slideable against the internal bore of the recoil spring tube; and an attaching member connected to the recoil spring tube for attaching the recoil spring tube assembly to the auto-loading firearm.

2. The recoil spring tube assembly of claim 1 wherein the recoil spring tube further comprises a corrosion resistant material.

3. The recoil spring tube assembly of claim 1 wherein the recoil spring tube further comprises a stainless steel material.

4. The recoil spring tube assembly of claim 1 wherein the recoil spring tube further comprises an internal bore having a polished surface having an average surface roughness between 1.0 $\mu$in. and 30.0 $\mu$in.

5. The recoil spring tube assembly of claim 1 wherein the recoil spring follower further comprises a corrosion resistant material.

6. The recoil spring tube assembly of claim 1 wherein the recoil spring follower further comprises a stainless steel.

7. The recoil spring tube assembly of claim 1 wherein the recoil spring tube further comprises an internal bore having a polished surface having an average surface roughness between 1.0 $\mu$in. and 30.0 $\mu$in.

8. The recoil spring tube assembly of claim 1 wherein the recoil spring further comprises a corrosion resistant material.

9. The recoil spring tube assembly of claim 1 wherein the recoil spring further comprises a stainless steel material.

10. The recoil spring tube assembly of claim 1 wherein the recoil spring further comprises a spring having a spring rate greater than 0.80 pounds per inch.

11. The recoil spring tube assembly of claim 1 further comprising a recoil spring follower mass to recoil spring rate displacement constant in the range of 0.10–0.30 inches.

12. An improved recoil spring tube assembly for an auto-loading 12 gauge shotgun, wherein the improvement comprises:

a recoil spring tube having a closed first end and an open second end, the recoil spring tube including an internal bore having a polished surface;

a recoil spring inserted and retained within the recoil spring tube;

a recoil spring follower inserted within the recoil spring tube and engaging the recoil spring, the recoil spring follower including at least one guide collar having a polished circumferential contact surface area having an average surface roughness in the range of 1.0 $\mu$in. to 30.0 $\mu$in., the circumferential contact surface area slideable against the internal bore of the recoil spring tube; and an attaching member connected to the recoil spring tube for attaching the recoil spring tube assembly to the auto-loading 12 gauge shotgun.

13. The recoil spring tube assembly of claim 12 wherein the recoil spring tube further comprises a stainless steel material.

14. The recoil spring tube assembly of claim 12 wherein the recoil spring tube including an internal bore having a polished surface further comprises an internal bore having a polished surface having an average surface roughness between 1.0 $\mu$in. and 30.0 $\mu$in.

15. The recoil spring tube assembly of claim 12 wherein the recoil spring follower further comprises a stainless steel.

16. The recoil spring tube assembly of claim 12 wherein the recoil spring follower including at least one guide collar having a polished reduced circumferential contact surface area further comprises a polished circumferential face having an average surface roughness between 1.0 $\mu$in. and 30.0 $\mu$in.

17. The recoil spring tube assembly of claim 12 wherein the recoil spring further comprises a spring having a spring rate greater than 0.80 pounds per inch.

18. The recoil spring tube assembly of claim 12 further comprising a recoil spring follower mass to recoil spring rate displacement constant in the range of 00.10–0.30 inches.

19. A recoil spring tube assembly for an auto-loading firearm comprising:

a recoil spring tube including an internal bore, the recoil spring tube also including a first end having a lip;

a recoil spring inserted within the recoil spring tube against the lip;

a recoil spring follower inserted within the recoil spring tube engaging the recoil spring, the recoil spring follower including at least one guide collar having a polished circumferential contact surface area having an average surface roughness in the range of 1.0 $\mu$in. to 30.0 $\mu$in., the circumferential contact surface area slideable against the internal bore of the recoil spring tube; and a keeper engageable with a second end of the recoil spring tube for retaining the recoil spring follower and the recoil spring within the recoil spring tube.

* * * * *